US011378020B2

(12) United States Patent
Wagner

(10) Patent No.: US 11,378,020 B2
(45) Date of Patent: Jul. 5, 2022

(54) METHOD FOR OPERATING A RECIPROCATING INTERNAL COMBUSTION ENGINE

(71) Applicant: Daimler AG, Stuttgart (DE)

(72) Inventor: Marc Oliver Wagner, Esslingen am Neckar (DE)

(73) Assignee: Daimler AG, Stuttgart (DE)

( * ) Notice: Subject to any disclaimer, the term of this patent is extended or adjusted under 35 U.S.C. 154(b) by 66 days.

(21) Appl. No.: 16/063,628

(22) PCT Filed: Oct. 24, 2016

(86) PCT No.: PCT/EP2016/001758
§ 371 (c)(1),
(2) Date: Jun. 18, 2018

(87) PCT Pub. No.: WO2017/102042
PCT Pub. Date: Jun. 22, 2017

(65) Prior Publication Data

US 2019/0003404 A1 Jan. 3, 2019

(30) Foreign Application Priority Data

Dec. 19, 2015 (DE) ..... 10 2015 016 526.7

(51) Int. Cl.
*F02D 13/04* (2006.01)
*F01L 1/36* (2006.01)
(Continued)

(52) U.S. Cl.
CPC ..... *F02D 13/04* (2013.01); *F01L 1/36* (2013.01); *F01L 13/065* (2013.01);
(Continued)

(58) Field of Classification Search
CPC .. F02D 13/04; F02D 13/0211; F02D 13/0273; F01L 1/36; F01L 13/065; F01L 2800/08
(Continued)

(56) References Cited

U.S. PATENT DOCUMENTS 4,592,319 A 6/1986 Meistrick
4,981,119 A * 1/1991 Neitz ..... F02M 26/01 123/321
(Continued)

FOREIGN PATENT DOCUMENTS

CN 102133892 A 7/2011
CN 102345517 A 2/2012
(Continued)

OTHER PUBLICATIONS

PCT/EP2016/001758, International Search Report dated Feb. 9, 2017 (Two (2) pages).
(Continued)

*Primary Examiner* — Logan M Kraft
*Assistant Examiner* — John D Bailey
(74) *Attorney, Agent, or Firm* — Crowell & Moring LLP

(57) ABSTRACT

A method for operating a reciprocating internal combustion engine in an engine braking mode includes, in a working cycle of the engine braking mode, a first outlet valve of a first cylinder is closed for a first time, then opened for a first time, and subsequently closed for a second time, and then opened for a second time, in order to thereby discharge gas that has been compressed in the first cylinder from the first cylinder by a cylinder piston. The outlet valve is held open after the first opening and prior to the second closing long enough for the cylinder to be filled with gas that flows out of a second cylinder via at least one outlet channel, where when the engine braking mode is activated, at least one
(Continued)

camshaft for activating at least one gas exchange valve of the reciprocating internal combustion engine is adjusted.

9 Claims, 3 Drawing Sheets

(51) Int. Cl.
*F02D 13/02* (2006.01)
*F01L 13/06* (2006.01)
*F02D 41/00* (2006.01)

(52) U.S. Cl.
CPC ..... *F02D 13/0211* (2013.01); *F02D 13/0219* (2013.01); *F02D 13/0273* (2013.01); *F01L 2800/00* (2013.01); *F01L 2800/08* (2013.01); *F02D 2041/001* (2013.01)

(58) Field of Classification Search
USPC ..... 123/345
See application file for complete search history.

(56) References Cited

U.S. PATENT DOCUMENTS 5,146,890 A * 9/1992 Gobert ..... F02D 13/04 123/321
5,172,610 A * 12/1992 Uzawa ..... F16H 61/4157 477/47
5,485,819 A 1/1996 Joko et al.
5,586,531 A * 12/1996 Vittorio ..... F02D 13/04 123/320
5,746,175 A * 5/1998 Hu ..... F01L 9/11 123/90.12
6,418,720 B1 * 7/2002 Cornell ..... F02B 39/16 123/321
6,513,471 B1 * 2/2003 Hicks ..... F01L 13/0005 123/90.16
2007/0129212 A1 * 6/2007 Lee ..... F16H 61/10 477/115
2008/0041336 A1 * 2/2008 Gibson ..... F02D 41/123 123/322
2010/0024767 A1 * 2/2010 Meneely ..... F02D 13/04 123/323
2010/0251983 A1 * 10/2010 Meistrick ..... F01L 1/08 123/90.46
2010/0319657 A1 * 12/2010 Dodi ..... F01L 13/065 123/321
2011/0036088 A1 * 2/2011 Xin ..... F02D 13/04 123/320
2011/0100324 A1 * 5/2011 Xin ..... F02D 13/04 123/322
2011/0120411 A1 * 5/2011 Ren ..... F02D 13/0253 123/321
2011/0277729 A1 * 11/2011 Afjeh ..... F02D 13/04 123/321
2012/0017868 A1 * 1/2012 Rammer ..... F02D 9/06 123/323
2012/0017869 A1 * 1/2012 Rammer ..... F02D 13/04 123/323
2012/0024260 A1 * 2/2012 Groth ..... F01L 1/18 123/321
2012/0048232 A1 * 3/2012 Meistrick ..... F01L 1/18 123/321
2012/0279463 A1 * 11/2012 Moller ..... F01L 13/06 123/90.12
2012/0298057 A1 * 11/2012 Janak ..... F01L 13/065 123/90.12
2013/0068195 A1 * 3/2013 Ruggiero ..... F01L 13/06 123/321
2014/0238015 A1 * 8/2014 Roberts ..... F01L 1/181 60/594
2014/0251266 A1 * 9/2014 Emmons ..... F02D 13/04 123/321
2014/0326212 A1 * 11/2014 Baltrucki ..... F01L 13/06 123/321
2014/0373808 A1 * 12/2014 Ernest ..... F01L 1/08 123/321
2015/0159520 A1 * 6/2015 Cecur ..... F01L 1/2411 123/90.12
2016/0025018 A1 * 1/2016 Gustafson ..... F01L 13/065 123/321
2016/0138488 A1 * 5/2016 Park ..... F02D 13/04 123/321
2016/0305293 A1 * 10/2016 Meneely ..... F01L 1/181
2016/0319753 A1 * 11/2016 Wagner ..... F02M 26/43
2017/0002702 A1 * 1/2017 Gunnarsson ..... F02D 13/0249
2017/0122232 A1 * 5/2017 Ruth ..... F02D 41/005
2019/0234317 A1 * 8/2019 Money ..... F02D 41/123

FOREIGN PATENT DOCUMENTS

CN 105829683 A 8/2016
DE 10 2007 007 758 A1 8/2008
DE 10 2007 038 078 A1 2/2009
DE 10 2013 022 037 A1 6/2015
EP 0 961 018 A1 12/1999
WO WO 2015/084243 A2 6/2015

OTHER PUBLICATIONS

Chinese-language Office Action issued in Chinese Application No. 201680074683.2 dated Jul. 3, 2020 with partial English translation (14 pages).

* cited by examiner

METHOD FOR OPERATING A RECIPROCATING INTERNAL COMBUSTION ENGINE

BACKGROUND AND SUMMARY OF THE INVENTION

The invention relates to a method for operating a reciprocating internal combustion engine.

A method of this kind for operating a reciprocating internal combustion engine in an exhaust braking mode is known from U.S. Pat. No. 4,592,319. In exhaust braking mode, the reciprocating internal combustion engine is used as a brake, i.e., as an exhaust brake for example for braking a motor vehicle. When travelling downhill, for example, the reciprocating internal combustion engine is used in exhaust braking mode in order to keep a speed of the motor vehicle at, least substantially constant or to prevent the speed of the motor vehicle from increasing excessively. Using the reciprocating internal combustion engine as an exhaust brake makes it possible to preserve a service brake of the motor vehicle. In other words, using the reciprocating internal combustion engine as an exhaust brake makes it possible to avoid using the service brake or to keep the use minimal.

For this purpose, according to the method, the reciprocating internal combustion engine is used or operated as a compression release brake. In other words, the reciprocating internal combustion engine is operated in exhaust braking mode in the manner of a compression release brake that is sufficiently known from the general prior art. Within the context of exhaust braking mode, within one operating cycle, at least one exhaust valve of at least one combustion chamber, in the form of a cylinder of the reciprocating internal combustion engine, is closed a first time. As a result, gas, for example fresh air, located in the cylinder can be compressed by means of a piston arranged in the cylinder. Following the first closure, the exhaust valve is opened, and therefore the air compressed by the piston is released from the cylinder, in particular abruptly. The release of the compressed air means that compression energy stored in the compressed air and provided by the piston can no longer be used in order to move the piston from the top dead center thereof to the bottom dead center thereof or to assist in such a movement. In other words, the compression energy is released from the cylinder at least substantially unused. Since the piston or the reciprocating internal combustion engine has to work in order to compress the gas in the cylinder, the opening of the exhaust valve meaning that it is not possible for the work to be used to move the piston from the top dead center to the bottom dead center, the motor vehicle can be braked.

The first opening of the exhaust valve is followed by a second closure. In other words, the exhaust valve is closed a second time following the first opening. As a result, gas still located in the cylinder can be compressed again by means of the piston for example. Following the second closure, the exhaust valve is opened a second time, with the result that the compressed gas can also be released from the cylinder a second time, without compression energy stored in the gas being able to be used to move the piston from the top dead center thereof to the bottom dead center thereof. The at least two openings and two closures are carried out within one operating cycle and are used to release gas, compressed in the cylinder by means of the piston of the cylinder, from the cylinder.

The piston is hingedly coupled to a crankshaft of the reciprocating internal combustion engine by means of a connecting rod. The piston can be moved in the cylinder, translationally relative to the cylinder, the piston moving from the bottom dead center thereof to the top dead center thereof. As a result of the hinged coupling to the crankshaft, the translational movements of the piston are converted into a rotational movement of the crankshaft, such that the crankshaft rotates about an axis of rotation. In a four-stroke engine, an "operating cycle" refers to precisely two complete rotations of the crankshaft. This means that one operating cycle of the crankshaft is a precisely 720 crank angle degrees. Within the 720 crank angle degrees [° KW], the piston moves twice into the top dead center thereof and twice into the bottom dead center thereof. In a two-stroke engine, an "operating cycle" is understood to be precisely one rotation of the crankshaft, i.e., 360 crank angle degrees [° KW].

The exhaust braking mode differs from a normal operating mode in particular in that, in exhaust braking mode, the reciprocating internal combustion engine is operated without fuel injection, by means of the reciprocating internal combustion engine being driven by wheels of the motor vehicle. In normal operating mode, however, the reciprocating internal combustion engine is operated in what is known as traction mode, in which the wheels are driven by the reciprocating internal combustion engine. Furthermore, in normal operating mode, fueled operation occurs, in which not only air, but also fuel, is introduced into the cylinder. This results, in normal operating mode, in a fuel-air mixture which is ignited and thus combusted.

In exhaust braking mode, however, no fuel is introduced into the cylinder, and therefore, in exhaust braking mode, the reciprocating internal combustion engine is operated in an unfurled operating mode.

Furthermore, DE 10 2007 038 078 A1 discloses a gas exchange valve actuation device, in particular for an internal combustion engine, comprising at least one firing camshaft, in particular an exhaust camshaft, which camshaft is phase-adjustable relative to a crankshaft by means of a firing camshaft adjustment device that comprises at least one brake cam and at least one decompression gas exchange valve. In this case, an adjustment device is provided which is designed to set a decompression gas exchange valve actuation timepoint.

The object of the present invention is therefore to develop a method of the type mentioned at the outset which makes it possible to achieve particularly high braking power.

In order to develop a method such that it is possible to achieve particularly high braking power in exhaust braking mode, according to the invention the exhaust valve is kept open, after the first opening and before the second closure, for as long as the cylinder is filled with gas, which gas in particular flows out of at least one second cylinder of the reciprocating internal combustion engine, which second cylinder is different from the cylinder, on an exhaust gas side of the reciprocating internal combustion engine, via at least one exhaust duct. In other words, according to the invention the gas is introduced into the first cylinder from at least one second cylinder, and the first cylinder is thus supercharged with the gas from the second cylinder. As a result, what is known as reverse supercharging can be achieved following a first decompression cycle of the first cylinder. The exhaust valve of the first cylinder then closes promptly the second time, such that the gas that is now located in the first cylinder and originated from the second cylinder is compressed by means of the piston of the first cylinder. Subsequently, the exhaust valve of the first cylinder can then be opened a second time, such that the first cylinder performs a second decompression cycle and compression energy stored in the compressed gas can be used to move the piston of the first cylinder from the top dead center thereof back to the bottom dead center thereof.

The exhaust valve of the first cylinder thus performs at least two temporally successive decompression strokes within one operating cycle, as a result of which the two decompression cycles of the first cylinder are brought about. In this case, the second decompression cycle is reverse supercharged once or a plurality of times, since, during the second decompression cycle, the gas from the second cylinder is located in the first cylinder. The reverse supercharging of the second decompression cycle makes it possible to achieve particularly high exhaust braking power in exhaust braking mode. The second decompression cycle or the second decompression stroke is preferably configured such that the pressure prevailing in the first cylinder does not increase above the value against which the at least one intake valve of the first cylinder can permanently open.

Compared with conventional valve timing in four-stroke engines in exhaust braking mode, a significant increase in the exhaust braking power can be achieved by means of the method according to the invention, in particular in a low engine speed range.

Furthermore, according to the invention, when the exhaust braking system is activated, a camshaft for actuating at least one gas exchange valve of the reciprocating internal combustion engine is adjusted. In particular in this case an intake camshaft is adjusted as the camshaft, by means of which intake camshaft it is possible to actuate an intake valve as the gas exchange valve. In this ease, the intake valve is associated with an intake duct via which the first cylinder is filled with the gas, in this case, the intake valve can be moved between a closed position that fluidically blocks the intake duct and at least one open position that fluidically releases the intake duct, and can be moved out of the closed position and into the open position by means of the camshaft.

In this case, the intake camshaft is adjusted before the exhaust braking mode itself is performed, i.e., before the above-described actuation of the exhaust valve. In other words, the intake camshaft is first adjusted, whereupon the exhaust valve is actuated in the manner described above and in the following, and/or the first cylinder is filled.

The background to the invention is that the method according to the invention makes it possible to implement an exhaust brake in the form of a three-stroke exhaust brake system. It has been found that, if no corresponding countermeasures are taken, the second decompression stroke or the second decompression cycle is restricted insofar as a pressure prevailing in the first cylinder, which pressure is also referred to as the cylinder pressure, may not exceed a maximum permissible cylinder pressure against which the intake valve can open, since otherwise the intake valve cannot be opened, i.e., cannot be moved from the closed position and into the open position, and therefore the intake duct cannot be released. In other words, it is desirable for the pressure prevailing in the first cylinder at the time at which the intake valve is opened to be low enough for it to be possible to open the intake valve so that the first cylinder can be filled with the gas.

Since the intake valve typically begins to open before the top dead center and, in exhaust braking mode, the maximum cylinder pressure arises at approximately the same crank angle, and the maximum permissible cylinder pressure against which the intake valve may open is in the range of approximately 20 bar, whereas the permissible cylinder pressure is otherwise over 60 bar, the limitations mean that it was not possible to make use of the full potential of the three-strike exhaust braking system.

In order to prevent this problem and to make use of the full potential of the three-stroke exhaust braking system, i.e., to achieve a particularly high braking power, the camshaft, in particular the intake camshaft, is adjusted.

When activating the exhaust braking system, very high cylinder pressures may arise, in particular in the case of high engine speeds and supercharge pressures, and therefore in the case of low cylinder pressures below 20 bar the intake camshaft can also be retarded and the exhaust valve can be actuated simultaneously in exhaust braking mode. Moreover, it is conceivable to first actuate the exhaust valve in accordance with the exhaust braking mode and to subsequently retard the intake camshaft. As a result, the intake valve can be adjusted before, during or after activation of the exhaust braking system.

An adjustment of the intake camshaft of this kind is to be understood to mean that the intake camshaft is rotated, and thus adjusted, relative to a crankshaft of the reciprocating internal combustion engine by means of a camshaft adjuster, which is also referred to as a phase adjuster. In this case, the crankshaft is an output shaft, by means of which the intake camshaft is driven.

This means that the invention is based on the concept of combining the three-stroke exhaust braking system with a camshaft adjuster. The camshaft adjuster makes it possible to shift, in particular towards later crank angles, the crankshaft range in which the gas exchange valve, in particular the intake valve, is opened. It is thus possible to retard the opening timepoint of the intake valve so as far that the cylinder pressure has dropped, on account of the open exhaust valve and the downward movement of the piston occurring after the top dead center, sufficiently far for the threshold value for the maximum cylinder pressure when the intake valve is open to be met even if the maximum cylinder pressure during the decompression is 60 bar or more.

Therefore, as a result of the exhaust braking mode being activated, the camshaft, in particular the intake camshaft, is set to a suitable position or a suitable rotational position, and in the process is in particular retarded. During exhaust braking mode, the intake camshaft is set to a position optimal for exhaust braking mode. After the exhaust braking mode has been disabled or deactivated, the intake camshaft is again rotated into a position or rotational position that is optimal for a normal operating mode or fueled operation of the reciprocating internal combustion engine. The camshaft adjuster preferably has a fail-safe position which the camshaft assumes in the event of a malfunction of the camshaft adjuster, the fail-safe position preferably being, the retarded position or rotational position of the camshaft.

Using the camshaft adjuster makes it possible to further increase the maximum possible exhaust braking power that can be achieved by the three-stroke exhaust braking system, and this can be achieved by particularly simple and cost-effective means in the form of the cam adjuster. In addition, the method according to the invention makes it possible to prevent further restrictions regarding the exhaust braking power due to activation and deactivation conditions, in particular when implemented mechanically, in which the threshold value of the maximum permissible cylinder pressure when the intake valve is open is again important, with the result that it is possible to achieve a particularly high braking power.

A further embodiment is characterized in that, in exhaust braking mode, within one operating cycle, at least one second exhaust valve of the second cylinder is closed a first time, subsequently opened a first time, subsequently closed a second time, and subsequently opened a second time, in order to thus release gas, compressed in the second cylinder by means of a second piston of the second cylinder, from the second cylinder. This means that the second cylinder or the second exhaust valve of the second cylinder is operated in the manner of the first cylinder or in the manner of the first exhaust valve of the first cylinder.

In this case, the first cylinder is filled with at least a portion of the gas released from the second cylinder, while the second exhaust valve of the second cylinder is opened at least in part following the second opening thereof and before the first closure thereof, or following the first opening thereof and before the second closure thereof. Since the second exhaust valve and the first exhaust valve are open at least in part, the gas compressed by the second piston can flow out of the second cylinder on the outlet or exhaust gas side of the reciprocating internal combustion engine, and can flow into the first cylinder via at least one exhaust duct of the first cylinder. A decompression cycle or a decompression stroke of the second cylinder or of the second exhaust valve is thus used to supercharge the first cylinder for the second decompression cycle thereof. This supercharging results in a particularly large amount of air being located in the first cylinder at the time of the second decompression stroke thereof, and therefore a particularly high exhaust braking power can be achieved.

Particularly high supercharging of the first cylinder can be achieved by means of the exhaust valve of the first cylinder being kept open, following the first opening and before the second closure, for as long as the first cylinder is filled with the gas flowing out of the second cylinder and out of at least one third cylinder of the reciprocating internal combustion engine, on the exhaust gas side, via at least one exhaust duct in each case. This means that the first cylinder is no longer supercharged only with gas from the second cylinder, but also with gas from the third cylinder, and therefore it is possible to achieve a particularly high exhaust braking power.

According to a further advantageous embodiment of the invention, in exhaust braking mode, within one operating cycle, at least one second exhaust valve of the second cylinder is closed a first time, subsequently opened a first time, subsequently closed a second time, and subsequently opened a second time, in order to thus release gas, compressed in the second cylinder by means of a second piston of the second cylinder, from the second cylinder. As already mentioned, in this case the second cylinder and the second exhaust valve thereof are operated in the manner of the first cylinder and the first exhaust valve thereof. Furthermore, in exhaust braking mode, within one operating cycle, at least one third exhaust valve of the third cylinder is closed a first time, subsequently opened a first time, subsequently closed a second time, and subsequently opened a second time, in order to thus release gas, compressed in the third cylinder by means of a third piston of the third cylinder, from the third cylinder. This means that the third cylinder and the third exhaust valve thereof are also operated in the manner of the first cylinder and the first exhaust valve thereof. As a result, a compression release brake is implemented in the three cylinders, and therefore it is possible to achieve a particularly high exhaust braking power.

The first cylinder is filled with at least a portion of the gas released from the second cylinder, while the second exhaust valve is opened following the second opening thereof and before the first closure thereof. Furthermore, the first cylinder is filled with at least a portion of the gas released from the third cylinder, while the third exhaust valve is opened at least in part following the first opening thereof and before the second closure thereof. In this case, the second decompression cycle of the second cylinder and the first decompression cycle of the third cylinder are also used to supercharge the first cylinder for the second decompression cycle thereof. As a result, a particularly large amount of air is located in the first cylinder at the time of the second decompression cycle, and therefore a particularly high exhaust braking power can be achieved.

Furthermore, for example, for the first decompression cycle thereof, the first cylinder is filled with gas in the form of fresh air, via at least one intake duct. In this case, an intake valve associated with the intake duet is in the open position thereof at least in part, and therefore, when the piston of the first cylinder is moved from the top dead center into the second dead center, gas in the form of fresh air can be sucked into the first cylinder via the intake duct. The fresh air can then be compressed in the first decompression cycle by means of the first piston. Following the first decompression cycle, the compressed fresh air flows out of the first cylinder. For the second decompression cycle, the first cylinder is supercharged with gas originating from the second decompression cycle of the second cylinder and from the first decompression cycle of the third cylinder.

The gas in each ease can flow out of the second cylinder and the third cylinder on the exhaust gas side of the reciprocating internal combustion engine via respective exhaust ducts, and can flow into the first cylinder via the at least one exhaust duct of the first cylinder.

For this purpose, the three cylinders are fluidically interconnected for example via an exhaust manifold that is arranged on the exhaust gas side and is used to guide exhaust gas or gas flowing out of the cylinders.

A further embodiment is characterized in that the exhaust valve of the first cylinder is kept open after the first opening, at least up to 210 crank angle degrees after the top dead center, in particular after the ignition top dead center, of the piston of the first cylinder. In this case, the ignition top dead center of the first piston is the top dead center of the piston in the region of which the fuel-air mixture is ignited during fueled operation of the reciprocating internal combustion engine. The ignition is, of course, omitted in exhaust braking mode, the term "ignition top dead center" merely serving to differentiate the ignition top dead center from the gas exchange top dead center (OT) that the first piston reaches when exhaust gas is discharged from the first cylinder.

Since the exhaust valve of the first cylinder is kept open at least up to 210 crank angle degrees after the ignition top dead center, the first cylinder can be supercharged with a particularly high amount of gas, and therefore it is possible to achieve a particularly high exhaust braking power.

It has been found to be particularly advantageous if the exhaust valves perform a smaller stroke in exhaust braking mode than in a normal operating mode that is different from exhaust braking mode, in particular traction mode, of the reciprocating internal combustion engine. This means that, unlike in normal operating mode (fueled operation or combustion operation), in exhaust braking mode the exhaust valves are not opened at full stroke. The full stroke is omitted in exhaust braking mode. Instead, the exhaust valve is opened at a smaller stroke compared therewith, specifically both in the case of the first opening and in the case of the second opening. In this case, it is possible for the strokes in the case of the first opening and in the case of the second opening to be equal, or for the exhaust valve of the first cylinder to be opened at different strokes in the case of the first opening and in the case of the second opening.

The invention also relates to a reciprocating internal combustion engine for a motor vehicle, which reciprocating internal combustion engine is designed to carry out a method according to the invention. Advantageous embodiments of the method according to the invention should be considered advantageous embodiments of the reciprocating internal combustion engine according to the invention, and vice versa.

Further advantages, features and details of the invention are can be found in the following description of embodiments and with reference to the figures. The features and combinations of features stated above in the description as well as the features and combinations of features stated below in the description of the figures and/or shown in the figures can be used not only in the combination specified in each case, but also in other combinations or in isolation without departing from the scope of the invention.

DETAILED DESCRIPTION OF THE DRAWINGS

Figure 1:
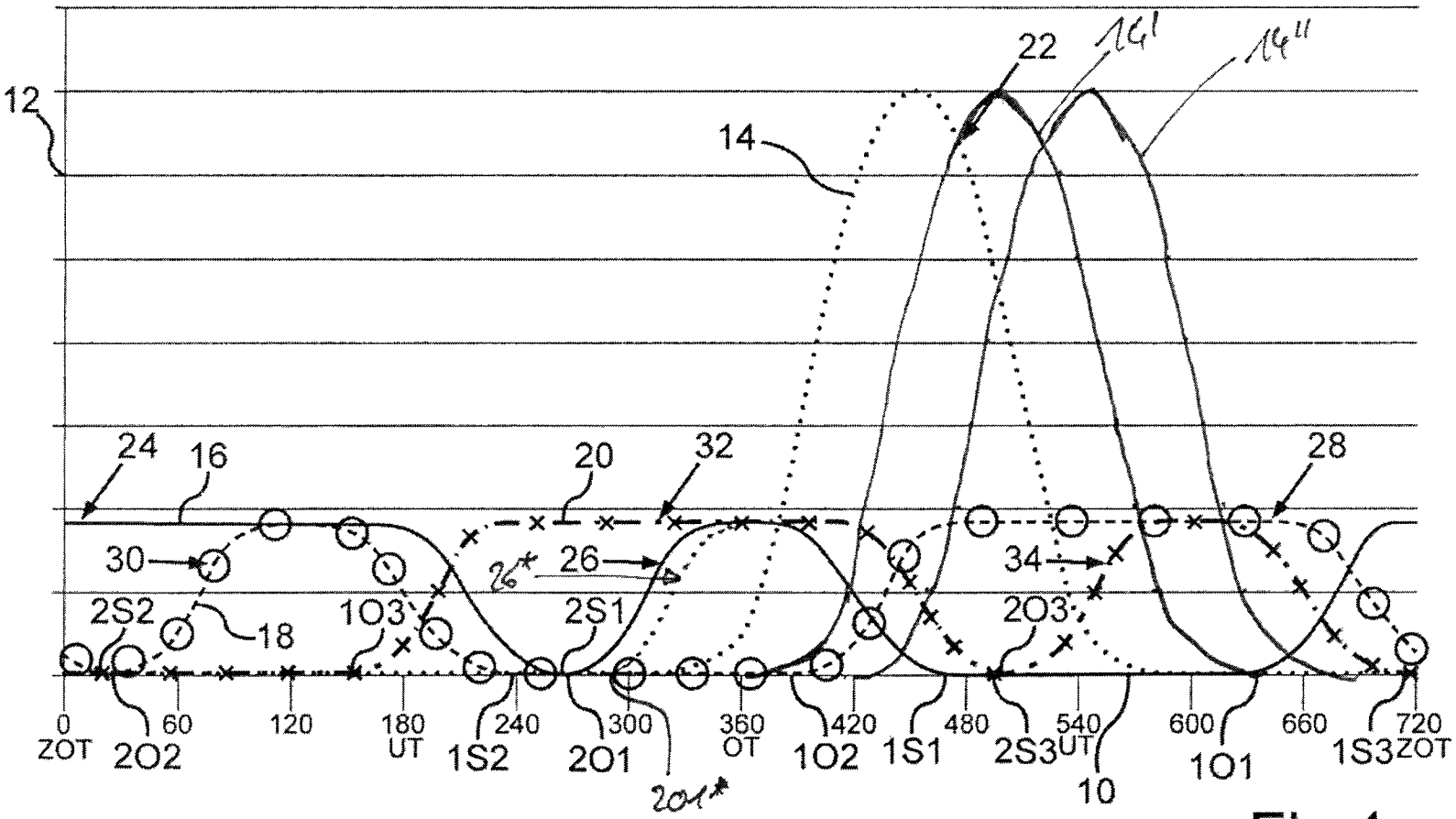
FIG. 1 is a graph illustrating a method for operating a reciprocating internal combustion engine in an exhaust braking mode, in which three exhaust valves of respective cylinders of the reciprocating internal combustion engine each perform two successive decompression strokes within one operating cycle in order to thus achieve a compression release brake having a particularly high exhaust braking power.

The figures serve to illustrate a method for operating a reciprocating internal combustion engine of a motor vehicle. The reciprocating internal combustion engine is used to drive the motor vehicle and comprises a total of for example six combustion chambers in the form of cylinders. The cylinders are arranged in series for example. Three first cylinders of the cylinders are arranged in a first cylinder bank, three second cylinders of the cylinders being arranged in a second cylinder bank. The cylinder banks each comprise a common exhaust manifold. The method will be described with reference to one of the cylinder banks, i.e., with reference to three of the six cylinders, the following explanations also being readily transferrable to the other cylinders and the other cylinder bank.

A first piston is arranged in a first of the three cylinders, the first piston being translationally movable. A second piston is arranged in a second of the cylinders, the second piston being translationally movable. A third piston is likewise arranged in the third cylinder, which third piston is translationally movable. The three pistons are hingedly coupled to a crankshaft of the reciprocating internal combustion engine by means of respective connecting rods. The crankshaft is mounted on a crankcase of the reciprocating internal combustion engine so as to be rotatable about an axis of rotation relative to the crankcase. As a result of the hinged coupling of the pistons to the crankshaft, the translational movements of the pistons are converted into a rotational movement of the crankshaft about the axis of rotation thereof.

In a normal operating mode of the internal combustion engine, fueled operation of the reciprocating internal combustion engine is carried out. Within the context of the fueled operation (normal operating mode), fuel and air are introduced into each of the cylinders. This results in a fuel-air mixture in each of the cylinders, which mixture is compressed.

At least one intake duct, respectively, is associated with each of the cylinders, via which intake duct air can flow into the relevant cylinder. The intake duct of the first cylinder is associated with a first intake valve which can be moved between at least one closed position that fluidically blocks the intake duct of the first cylinder and at least one open position that fluidically releases the intake duct of the first cylinder. Accordingly, the intake duct of the second cylinder is associated with a second intake valve which can be moved between a closed position that fluidically blocks the intake duct of the second cylinder and at least one open position that fluidically releases the intake duct of the second cylinder at least in part. The intake duct of the third cylinder is also associated with an intake valve which can be moved between a closed position that fluidically blocks the intake duct of the third cylinder and at least one open position that fluidically releases the intake duct of the third cylinder at least in part. If the relevant intake valve is in the open position thereof, the air can flow into the relevant cylinder via the intake duct.

Ignition and combustion of the fuel-air mixture results in exhaust gas in the relevant cylinder. In this case, at least one exhaust duct, respectively, is associated with each of the cylinders, via which exhaust duct the exhaust gas can flow out of the relevant cylinder. The exhaust duct of the first cylinder is associated with a first exhaust valve which can be moved between a closed position that fluidically blocks the exhaust duct of the first cylinder and at least one open position that fluidically releases the exhaust duct of the first cylinder at least in part. Accordingly, the exhaust duct of the second cylinder is associated with a second exhaust valve which can be moved between a closed position that fluidically blocks the exhaust duct of the second cylinder and at least one open position that fluidically releases the exhaust duct of the second cylinder at least in part. The exhaust duct of the third cylinder is also associated with an third exhaust valve which can be moved between a closed position that fluidically blocks the exhaust duct of the third cylinder and at least one open position that fluidically releases the exhaust duct of the third cylinder at least in part, if the relevant exhaust valve is in the open position thereof, the exhaust gas can flow out of the relevant cylinder via the relevant exhaust duct.

In this case, the air flows into the cylinders on what is referred to as an intake side. The exhaust gas flows out of the cylinders on what is known as an outlet or exhaust gas side. The exhaust manifold common to the three cylinders of the cylinder hank is arranged on the outlet side, which manifold is used to guide the exhaust gas flowing out of the cylinders.

The intake valves and the exhaust valves are actuated by means of an intake camshaft and an exhaust camshaft, respectively, for example, and as a result are in each case moved out of the respective closed positions and into the respective open positions and optionally kept in the open position. This is also referred to as valve timing. The intake and exhaust camshafts open the intake valves and the exhaust valves at specifiable timepoints or positions of the crankshaft. Furthermore, the intake and exhaust camshafts in each case allow closure of the intake valves and the exhaust valves at specifiable timepoints or rotational positions of the crankshaft.

The relevant rotational positions of the crankshaft about the axis of rotation thereof are typically also referred to as "crank angle degrees" [° KW]. The figures show graphs, on the x-axes 10 of which the rotational positions, i.e., crank angle degrees, of the crankshaft are plotted.

In this case, the reciprocating internal combustion engine is designed as a four-stroke engine, an operating cycle of the crankshaft comprising precisely two rotations of the crankshaft. In other words, one operating cycle is precisely 720 ['KW]. Within an operating cycle of this kind, i.e., within 720 crank angle degrees [° KW], the relevant piston moves twice into the top dead center (OT) thereof and twice into the bottom dead center (UT) thereof.

The dead center in the region of which the compressed fuel-air mixture is ignited during fueled operation of the reciprocating internal combustion engine is referred to as the ignition top dead center (ZOT). In order to achieve good legibility of the graph shown in the figures, the ignition top dead center (ZOT) is plotted twice, specifically once at 720 crank angle degrees and once at 0 crank angle degrees, this being the same rotational position of the crankshaft and of the camshaft.

The references "UT" for the bottom dead center, "OT" for the top dead center and "ZOT" for the ignition top dead center, provided in the graphs shown in the figures, refer to the positions of the first piston. The 720 [° KW] shown in the graphs therefore relate to one operating cycle of the first cylinder and of the first piston. Based on the operating cycle of the first piston, the second piston and the third piston reach the respective top dead centers thereof and the respective bottom dead centers or ignition top dead centers thereof at different rotational positions of the crankshaft. The following explanations regarding the first exhaust valve and the first intake valve relate to the relevant bottom dead center UT at 180 [° KW] and 540 [° KW], the top dead center OT (gas exchange top dead center) at 360 [° KW], and the ignition top dead center ZOT of the first piston at 0 [° WK] or 720 [° KW], and can also readily relate to the second exhaust valve of the second cylinder, although with reference to the relevant bottom dead center, the top dead center and the ignition top dead center of the second piston, and to the third exhaust valve, although with reference to the relevant bottom dead center, the top dead center and the ignition top dead center of the third piston.

With reference to the relevant operating cycle of the relevant cylinder, the cylinders, and thus the exhaust valves and the intake valves, are operated in the same manner.

The graphs also have a y-axis 12, on which the relevant stroke of the relevant intake valve and of the relevant exhaust valve is plotted. During the stroke, the relevant exhaust valve or relevant intake valve is moved, i.e., opened and closed.

A curve 14 is plotted in a dashed line in the graph in FIG. 1. The curve 14 characterizes the movement, i.e., the opening and closure, of the first intake valve of the first cylinder. For the sake of clarity, only the curve of the first intake valve of the first cylinder is shown on the graph. A curve 16 is also plotted on the graph, by a solid line, which curve characterizes the opening and closure of the first exhaust valve of the first cylinder in exhaust braking mode. A curve 18 provided with circles characterizes the opening and closure of the second exhaust valve of the second cylinder on the basis of the operating cycle of the first cylinder and of the first piston. A curve 20 provided with crosses characterizes the opening and closure of the third exhaust valve of the third cylinder on the basis of the operating cycle of the first cylinder. The curve 18 of the second exhaust valve of the second cylinder is thus shown retarded by 480 crank angle degrees with respect to the operating cycle of the first cylinder, in accordance with a firing order 1-5-3-6-2-4 of an in-line six-cylinder engine, and the curve 20 of the third exhaust valve of the third cylinder is correspondingly retarded by 240 crank angle degrees. The higher the relevant curve 14, 16, 18, 20, the further the intake valve or the relevant exhaust valve is open at an associated rotational position (crank angle degrees) of the crankshaft. If the relevant curve 14, 16, 18, 20 is located at the value "zero" plotted on the y-axis, the intake valve or the relevant exhaust valve is closed. In other words, the curves 14, 16, 18, 20 are the respective valve lift curves of the intake valves or of the relevant exhaust valves.

The method described in the following is implemented in an exhaust braking mode of the reciprocating internal combustion engine. It can be seen from FIG. 1, on the basis of the curve 14, that the first intake valve of the first cylinder is opened in the region of the top dead center OT of the first piston and is closed in the region of the bottom dead center UT of the first piston. As a result, the first intake valve performs an intake stroke 22, such that gas in the form of fresh air can flow into the first cylinder via the intake duct thereof, the gas being drawn by the piston moving from the top dead center OT to the bottom dead center UT.

As can be seen on the basis of the curve 16, the first exhaust valve is closed twice and opened twice within one operating cycle of the first cylinder or of the first piston.

With respect to the intake stroke 22 of the first intake valve, within the operating cycle of the first cylinder or of the first piston, the first exhaust valve of the first cylinder is closed a first time at a rotational position of the crankshaft that is denoted 1S1 and is just before 480 [° WK]. In this ease, the rotational position 1S1 is located in the region of the intake stroke 22. Within the operating cycle of the first cylinder or of the first piston, following the first closure, the first exhaust valve is opened a first time at a rotational position of the crankshaft that is denoted 1O1 and is just before 660 [° KW]. Subsequently, the first exhaust valve is closed a second time at a rotational position of the crankshaft that is denoted 2S1 and is just after 240 [° KW]. Subsequently, the first exhaust valve is opened a second time at a rotational position of the crankshaft that is denoted 2O1 and is at approximately 270 [° KW].

As a result of the first closure (1S1), the fresh air located in the first cylinder is compressed by the first piston following the closure of the first intake valve. As a result of the first opening and the second closure, the first exhaust valve performs a first decompression stroke 24 within the operating cycle of the first cylinder, such that the first cylinder performs a first decompression cycle. In this case, as a result of the first opening (at 1O1) the fresh air previously compressed by the first piston or the gas previously compressed by the first piston is released from the first cylinder via the exhaust duct of the first cylinder, without it being possible for the compression energy stored in the compressed gas to be used to move the piston out of the top dead center thereof and into the bottom dead center thereof. Since the reciprocating internal combustion engine previously had to work to compress the gas, this is associated with braking of the reciprocating internal combustion engine and thus of the motor vehicle. As a result of the second opening at the rotational position 2O1 and the first closure 1S1, the first exhaust valve performs a second decompression stroke 26 within the operating cycle of the first cylinder, such that the first cylinder performs a second decompression cycle.

Within the context of the second decompression stroke 26 or of the second decompression cycle, within one operating cycle of the first cylinder or of the first piston, gas compressed by the first piston in the first cylinder is released from the first cylinder for a second time via the exhaust duct of the first cylinder, without it being possible for the compression energy stored in the gas to be used to move the piston out of the top dead center thereof and into the bottom dead center thereof. As a result, it is possible to achieve a particularly high braking power, i.e., a particularly high exhaust braking power, in exhaust braking mode.

In exhaust braking mode, the first exhaust valve and the second and third exhaust valve perform a significantly smaller stroke than in normal operating mode, during fueled operation of the reciprocating internal combustion engine.

It can further be seen from the figure, on the basis of the curve 18, that, in exhaust braking mode, within one operating cycle of the second cylinder or of the second piston, the second exhaust valve of the second cylinder is closed a first time at a rotational position of the crankshaft denoted 1S2. With reference to the intake stroke (not shown in the figures) of the second intake valve of the second cylinder, the first opening likewise takes place in the region of the intake stroke of the second intake valve. Within the operating cycle of the second cylinder, following the first closure, the second exhaust valve is opened a first time at a rotational position of the crankshaft that is denoted 1O2. Subsequently, within the operating cycle of the second cylinder, the second exhaust valve is closed a second time at a rotational position of the crankshaft that is denoted 2S2, and the valve is subsequently opened a second time at a rotational position of the crankshaft that is denoted 2O2. As a result of the first opening (at rotational position 1O2) and of the second closure (at rotational position. 2S2) of the second exhaust valve, the second exhaust valve performs a first decompression stroke 28. As a result of the second opening and the first closure, the second exhaust valve performs a second decompression stroke within the operating cycle of the second cylinder. As a result of the first closure of the second exhaust valve, gas in the form of fresh air, which gas was sucked into the second cylinder by means of the second piston, as a result of the opening of the second intake valve, is compressed after the second intake valve is closed. During the course of the first decompression stroke 28 of the second exhaust valve, i.e., during the course of a first decompression cycle of the second cylinder, the compressed gas is released from the second cylinder via the second exhaust duct, and therefore it is not possible for the compression energy stored in the compressed gas to be used to move the second piston out of the top dead center thereof and back into the bottom dead center thereof. This process is repeated within the context of the second decompression stroke 30, and therefore the second cylinder also performs two decompression cycles within one operating cycle of the second cylinder.

The same applies to the third cylinder. As can be seen on the basis of the curve 20, in exhaust braking mode, within one operating cycle of the third cylinder or of the third piston, is closed a first time at a rotational position of the crankshaft denoted 1S3. Subsequently, within the operating cycle of the third cylinder, the third exhaust valve is opened a first time at a rotational position of the crankshaft denoted 1O3. Subsequently, the third exhaust valve is closed a second time at a rotational position of the crankshaft denoted 2S3. Subsequently, the third exhaust valve is opened a second time at a rotational position of the crankshaft denoted 2O3. As a result of the first opening (at rotational position 1O3) and the second closure (at rotational position 2S3), the third exhaust valve performs a first decompression stroke 32 within an operating cycle, such that the third cylinder performs a first decompression cycle. As in the case of the first cylinder and the second cylinder, the rotational position 1S3 at which the third exhaust valve is closed the first time within the operating cycle of the third cylinder or of the third piston, is likewise in the region and preferably in the region of the intake stroke of the third intake valve of the third cylinder. In the same way as in the case of the first cylinder and in the case of the second cylinder, as a result of the first closure of the third exhaust valve, gas in the form of fresh air, which gas was sucked into the third cylinder, by means of the third piston, as a result of opening the third intake valve, is compressed by the third piston after the third intake valve is closed. As a result of the first opening (at rotational position 1O3) of the third exhaust valve, the compressed gas is released from the third cylinder, and therefore it is not possible for compression energy stored in the compressed gas to be used to move the third piston out of the top dead center thereof and into the bottom dead center thereof.

As a result of the second opening (at rotational position 2O3) and the first closure (at rotational position 1S3), the third exhaust valve performs a second decompression stroke 34 within the operating cycle of the third cylinder, the third cylinder performing a second decompression cycle during the course of the second decompression stroke 34 of the third exhaust valve. Again within the context of the second decompression cycle, compressed gas is released from the third cylinder via the third exhaust duct, and therefore it is not possible for compression energy stored in the compressed gas to be used to move the third piston out of the top dead center and into the bottom dead center. In the same way as the first exhaust valve within the operating cycle of the first cylinder, and the second exhaust valve within the operating cycle of the second cylinder, the third exhaust valve of the third cylinder performs two decompression strokes 32, 34 within the operating cycle of the third cylinder, which decompression strokes are in succession within the operating cycle of the third cylinder. The three cylinders thus each perform two successive decompression cycles within the relevant operating cycle, as a result of which it is possible to achieve a particularly high exhaust braking power in exhaust braking mode.

The crank angle degree at which the second and third exhaust valve open and close in each case are correspondingly offset by 480 [° KW] and 240 [° KW], respectively, relative to the first cylinder.

In order to now achieve a particularly high exhaust braking power in exhaust braking mode, following the first opening (at rotational position 1O1) and before the second closure (at rotational position 2S1), the first exhaust valve of the first cylinder is kept open after the initial decompression for as long as the first cylinder is refilled with gas flowing out of the second cylinder, on the exhaust gas side, via the second exhaust duet, and with gas flowing out of the third cylinder, on the exhaust gas side, via the third exhaust duct, it can be seen, on the basis of the curve 16, that the first exhaust valve is kept open until just after 240 crank angle degrees after the ignition top dead center ZOT of the first piston, or is not completely closed until just after 240 crank angle degrees after the ignition top dead center ZOT. As can be seen in the figure, based on the operating cycle of the first cylinder, the second decompression stroke 30 of the second exhaust valve is still completely within the first decompression stroke 24 of the first exhaust valve. Moreover, the first decompression stroke 32 of the third exhaust valve is within the first decompression stroke 24 in part, since, based on the operating cycle of the first cylinder, the third exhaust valve is already opened before 180 crank angle degrees after the ignition top dead center ZOT of the first piston. This means that, during the first decompression stroke 24 of the first exhaust valve, a decompression stroke of the second exhaust valve (second decompression stroke 30) and a decompression stroke of the third exhaust valve (first decompression stroke 32) takes place at least in part. As a result, the first cylinder can be supercharged, for the second decompression cycle (decompression stroke 26) that follows the first decompression cycle (decompression stroke 24), with gas from the second cylinder and from the third cylinder, as a result of which a particularly high exhaust braking power can be provided. In this case, the first cylinder is supercharged, for the second decompression cycle thereof, with gas from the second decompression cycle of the second cylinder and with gas from the first decompression cycle of the third cylinder. In the embodiment shown according to FIG. 1, all three exhaust valves are temporarily opened simultaneously by means of the first opening of the third exhaust manifold at the rotational position 1O3, and therefore the cylinders are fluidically interconnected by means of the first exhaust manifold.

Following the first opening 1O1 and before the second closure 2S1, the first exhaust valve should be kept open for as long as the first cylinder is filled with gas flowing out of at least one second cylinder of the reciprocating internal combustion engine via at least one exhaust duct. This means that the first cylinder is intended to be filled at least with gas from the second or third cylinder.

This principle can also be readily transferred to the second cylinder and to the third cylinder. This means that, for example, within the operating cycle of the second cylinder, the second cylinder is filled, i.e., supercharged, for the second decompression cycle thereof, with gas from the first cylinder and with gas from the third cylinder. Within the operating cycle of the third cylinder, the third cylinder is supercharged, for the second decompression cycle, with gas from the first cylinder and with gas from the second cylinder. This is advantageous since, as can be seen from the figure on the basis of the first cylinder for example, an intake stroke of the first intake valve is no longer performed after the first decompression cycle or after the first decompression stroke and before the second decompression cycle or before the second decompression stroke 26. This means that the first cylinder cannot be filled with gas via the intake duct of the first cylinder after the first decompression cycle and before the second decompression cycle. The first cylinder is therefore filled with gas, for the second decompression cycle thereof, via the exhaust duct of the first cylinder, the gas originating both from the second cylinder and from the third cylinder.

There is therefore an overlap between the second closure of the first exhaust valve and, based on the operating cycle of the third cylinder, the first opening of the third exhaust valve. Advantageously, pressure peaks in the exhaust manifold due to the gas flowing out of the first cylinder and flowing into the second or third cylinder can be reduced by means of the overlap between the respective opening of a first exhaust valve and the closure of a third exhaust valve and/or the closure of a second exhaust valve.

Figure 2:
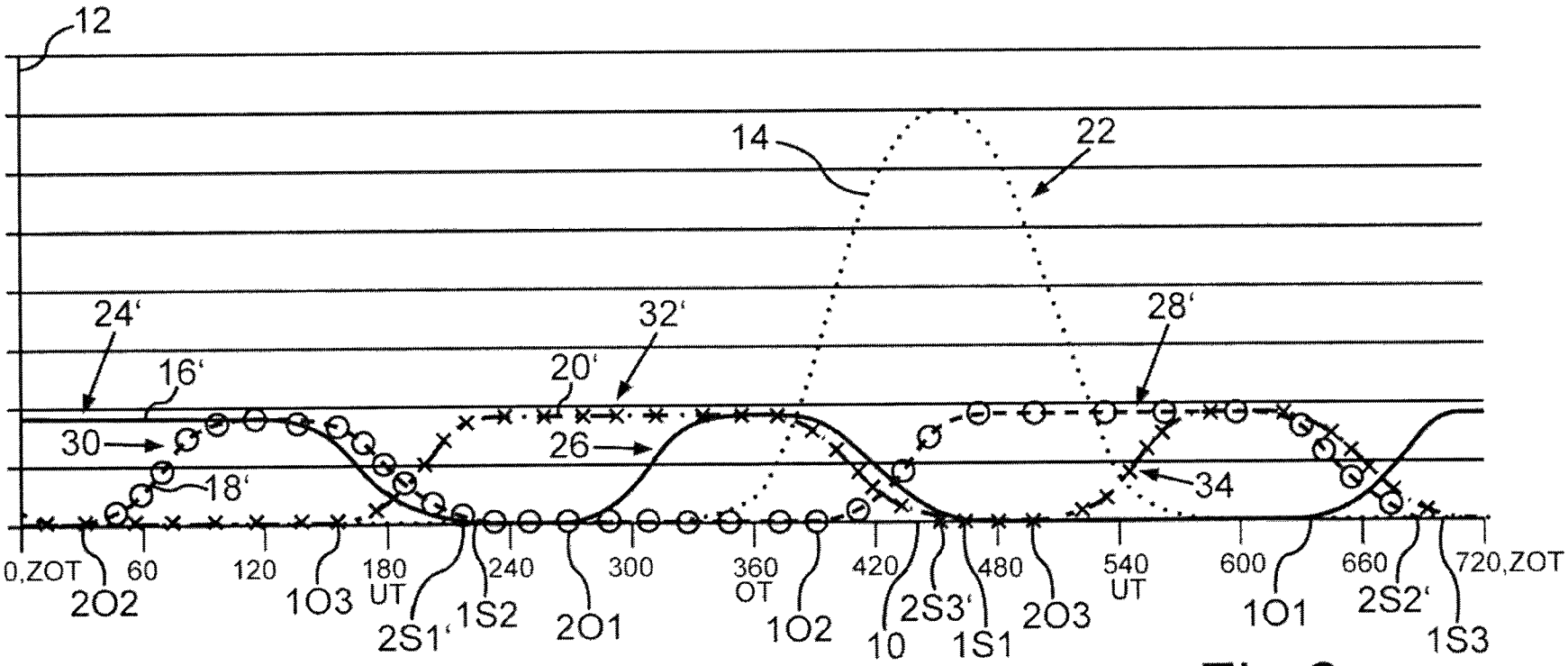
FIG. 2 shows an alternative embodiment compared with FIG. 1.

FIG. 2 shows an alternative embodiment compared with FIG. 1. In this case, the same lines and the same points are provided with the same reference signs in FIG. 2 as in FIG. 1. The curve 14, unchanged compared to FIG. 1, is plotted in the graph in FIG. 2. Unlike in FIG. 1, the curves 16', 18' and 20' each have first decompression strokes 24', 28" and 32' that close earlier. The second closure 2S1', 2S2' and 2S3' of the first decompression strokes 24', 28' and 32' occurs approximately 30 crank angle degrees earlier in each case. As a result, for example the first exhaust valve closes at approximately 210 crank angle degrees and the first closure timepoints 1S1, 1S2 and 1S3 of the second, unchanged decompression strokes 26, 30, 34 are temporally after the second closure 2S1', 2S2' and 2S3' of the first decompression strokes 24', 28' and 32'.

Figure 3:
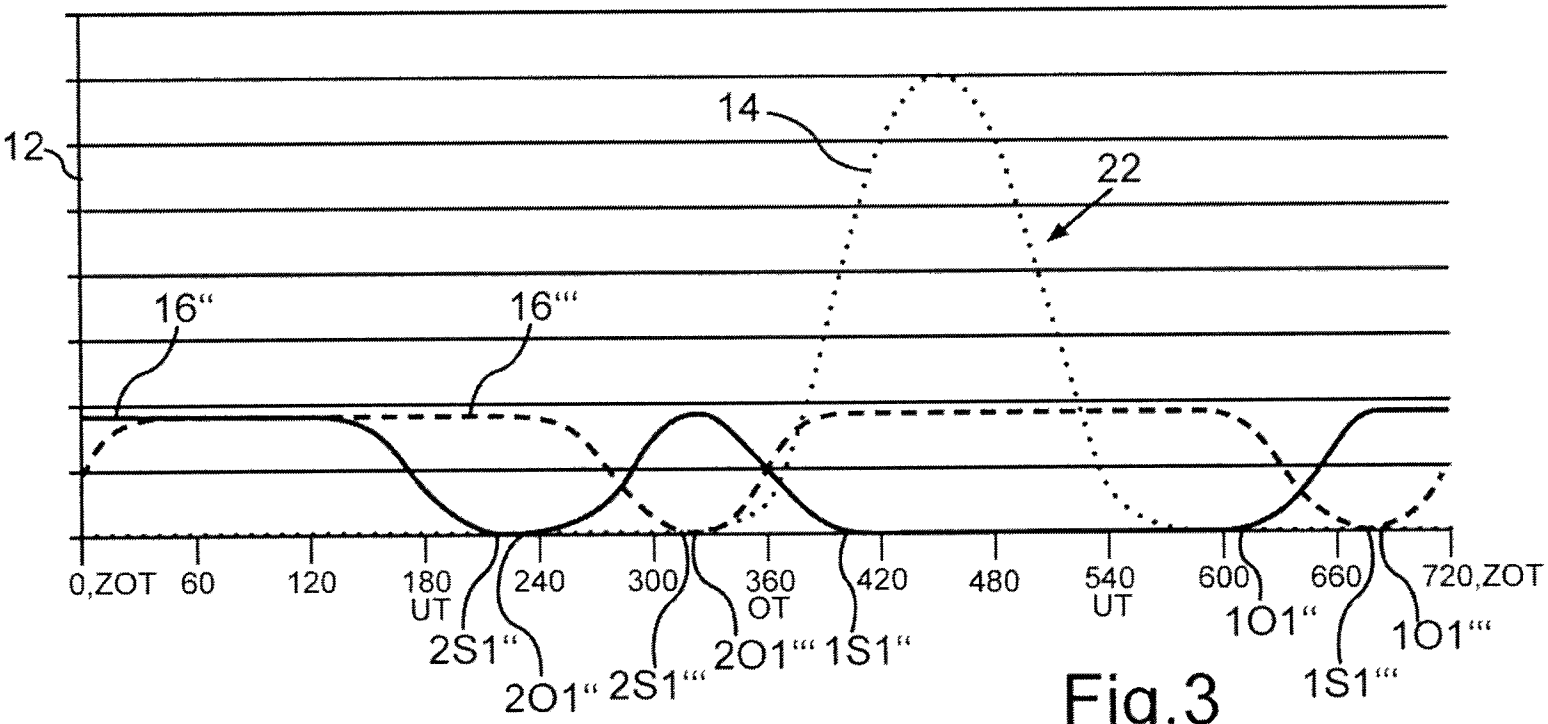
FIG. 3 is a graph showing preferred ranges of the respective opening and closing timepoints of the two successive decompression strokes, on the basis of a first exhaust valve.

FIG. 3 is a graph showing preferred ranges of the respective opening and closing timepoints of the two successive decompression strokes, on the basis of the first exhaust valve. The following explanations are also readily transferrable to the other cylinders and the other cylinder bank. In this case, the same lines and the same points are provided with the same reference signs in FIG. 3 as in FIG. 1 and FIG. 2. The curve 14, unchanged compared to FIG. 1, is plotted in the graph in FIG. 2. Furthermore, two curves 16" (solid line) and 16'" (dashed line) of the first exhaust valve are plotted in FIG. 3, the curve 16" indicating the earliest possible opening time points 1O1" at approximately 610 crank angle degrees and 2O1" at approximately 230 crank angle degrees, and closure timepoints 1S1" at approximately 400 crank angle degrees and 2S1" at approximately 210 crank angle degrees. Accordingly, the curve 16'" indicates the latest possible opening time points 1O1 at approximately 680 crank angle degrees and 2O1'" at approximately 320 crank angle degrees, and closure timepoints 1S1'" at approximately 680 crank angle degrees and 2S1'" at approximately 320 crank angle degrees. The resulting ranges of possible first and second opening timepoints and first and second closure timepoints can be combined as desired.

In order to achieve a particularly high braking power, i.e., a particularly high exhaust braking power, the camshaft for actuating the intake valves is adjusted by means of a camshaft adjuster, and in the process retarded relative to the crankshaft, when activating the exhaust braking mode. The camshaft for actuating the intake valve is also referred to as the intake camshaft. The function and effect of the adjustment of the intake camshaft will be described in the following, using the example of the first cylinder. At least one intake valve and at least one intake duct are associated with the first cylinder, the intake valve being associated with the intake duct. The intake valve can be adjusted between a closed position and at least one open position, the intake duct of the first cylinder being fluidically blocked by the intake valve in the closed position thereof. In the open position, the intake valve releases the intake duct at least in part. In this case, the intake valve can be moved out of the closed position thereof into the open position thereof by means of the camshaft. A curve 14 of the opening and closure of the intake valve of the first cylinder is plotted in a dashed line in the graph in FIG. 1.

The camshaft adjuster now makes it possible to shift the crank angle range, in which the intake valve is opened, towards later crank angles. The curve 14' of the opening and closure of the intake valve of the first cylinder at later crank angles is plotted in a solid line in the graph in FIG. 1. In the embodiment shown according to FIG. 1, the curve 14 of the opening and closure of the intake valve is retarded by approximately 45 [° KW] relative to the curve 14. The intake valve thus no longer opens before the top dead center (OT), but instead after the top dead center (OT). The closure of the intake valve is shifted correspondingly. It is thus possible to retard the opening timepoint at which the intake valve is opened so as far that a pressure prevailing in the first cylinder, which pressure is also referred to as the cylinder pressure, has dropped, on account of the open exhaust valve and the downward movement of the piston, after the OT sufficiently far for a threshold value for a maximum cylinder pressure when the intake valve is open to be met even if the maximum cylinder pressure during compression is 60 bar or more, i.e., is particularly high. In other words, it is thus possible to achieve particularly high pressures in the first cylinder during the second decompression or during the second decompression stroke. On account of the adjustment of the intake camshaft, it is possible in this case, despite the high cylinder pressures, to open the intake valve, which valve has to be opened against the pressure prevailing in the first cylinder, and to thus allow the first cylinder to be filled with the gas, since the pressure in the first cylinder when the intake valve is opened is lower than the maximum permissible cylinder pressure. It is thus possible to achieve a particularly high braking power.

The braking power can be increased yet further by means of the respective second opening of the exhaust valves at the second decompression stroke occurring later, together with the above-mentioned retardation of the intake valve. This is shown by way of example in FIG. 1 for the second decompression stroke of the first exhaust valve, on the basis of the dotted curve 26*. The timepoint 2O1 of the second opening of the first exhaust valve is retarded to timepoint 2O1*. In contrast, the timepoint 1S1 of the first closure of the first exhaust valve remains unchanged. This can be expressed in a corresponding change in the exhaust cam contour. The retarded opening of the exhaust valve can further increase the compression of the gas located in the cylinder, which results in a higher braking power.

It is also conceivable, similarly to the adjustment of the intake camshaft, by means of a camshaft adjuster, to provide a corresponding camshaft adjuster for the exhaust camshaft. It is thus possible to variably select a timepoint for the opening of the exhaust valve, in particular so as to be retarded. The timepoint of the closure of the exhaust valve is shifted correspondingly.

Furthermore, it may be advantageous to set low or particularly low exhaust braking powers. For this purpose, the opening and closure of the intake valve can be retarded further. As a result, the gas in the cylinder is pushed out of the open intake duct again by means of the upward movement of the piston, such that, after the intake valve has closed, there is less gas available to the cylinder for the compression, as a result of which less gas can be released in the first decompression, in the graph in FIG. 1, the curve 14" of the opening and closure of the intake valve of the first cylinder is retarded by approximately 120 [° KW] relative to the curve 14. The intake valve thus opens significantly after the top dead center (OT). The closure of the intake valve is shifted correspondingly. The upward movement of the piston towards the ignition top dead center ZOT is a limiting factor for the retardation for reducing the braking power. In order to prevent the intake valve from colliding with the piston, the intake valve must be closed promptly.

The use of the camshaft adjuster, which is also referred to as a phase adjuster, and the adjustment of the camshaft, in particular of the intake camshaft, brought about thereby, makes it possible to achieve an exhaust brake, and thus an exhaust braking system, having a variable intake valve lift curve, since the lift curve of the intake valve can be varied by means of adjusting the intake camshaft. The above-described actuation of the gas exchange valve further makes it possible to implement the exhaust braking system as a three-stroke exhaust braking system, such that it is possible to provide a particularly high braking power and also particularly low braking powers.

The invention claimed is:

1. A method for operating a reciprocating internal combustion engine in an exhaust braking mode, in which a camshaft for actuating a gas exchange valve of the reciprocating internal combustion engine is adjusted when the exhaust braking mode is activated, comprising:

within one operating cycle of a first cylinder, closing a first exhaust valve of the first cylinder a first time, subsequently opening the first exhaust valve of the first cylinder a first time, keeping the first exhaust valve open while a second exhaust valve opens and for as long as the first cylinder is filled with gas flowing out of a second cylinder of the reciprocating internal combustion engine via an exhaust duct and until the second exhaust valve closes, closing the second exhaust valve, subsequently closing the first exhaust valve of the first cylinder a second time, and subsequently opening the first exhaust valve of the first cylinder a second time in order to release gas, compressed in the first cylinder by a first piston of the first cylinder, from the first cylinder; and within another operating cycle of the first cylinder following the one operating cycle of the first cylinder, retarding an opening timepoint at which subsequent opening of the first exhaust valve of the first cylinder the second time occurs relative to an opening timepoint at which subsequent opening of the first exhaust valve of the first cylinder the second time occurs within the one operating cycle of the first cylinder while keeping a closing timepoint at which the first exhaust valve closes the first time unchanged from the closing timepoint at which the first exhaust valve closes the first time in the one operating cycle of the first cylinder, thereby increasing said braking power prior to opening the second exhaust valve of the second cylinder in the other operating cycle of the first cylinder.

2. The method according to claim 1, wherein the camshaft is an intake camshaft and wherein via the intake camshaft it is possible to actuate, as the gas exchange valve, an intake valve that is associated with an intake duct via which the first cylinder is filled with the gas.

3. The method according to claim 2, wherein the intake camshaft is retarded.

4. The method according to claim 1, wherein an exhaust camshaft is retarded.

5. The method according to claim 1, wherein within one operating cycle of the second cylinder, a second exhaust valve of the second cylinder is closed a first time, subsequently opened a first time, subsequently closed a second time, and subsequently opened a second time, in order to release gas, compressed in the second cylinder by a second piston of the second cylinder, from the second cylinder, and wherein the first cylinder is filled with at least a portion of the gas released from the second cylinder.

6. The method according to claim 1, wherein the first exhaust valve of the first cylinder is kept open, following the first opening and before the second closure, for as long as the first cylinder is filled with the gas flowing out of the second cylinder and out of a third cylinder of the reciprocating internal combustion engine.

7. The method according to claim 1, wherein keeping the first exhaust valve of the first cylinder open is performed at least up to 210 crank angle degrees after a top dead center of the first piston of the first cylinder.

8. The method according to claim 1, wherein the first exhaust valve performs a smaller stroke in the exhaust braking mode than in a normal operating mode that is different from the exhaust braking mode.

9. A reciprocating internal combustion engine for a motor vehicle, wherein the reciprocating internal combustion engine carries out the method according to claim 1.

* * * * *